US009378873B2

(12) United States Patent
Yoshioka et al.

(10) Patent No.: US 9,378,873 B2
(45) **Date of Patent: *Jun. 28, 2016**

(54) SHUNT RESISTOR AND METHOD FOR MANUFACTURING THE SAME

(71) Applicant: KOA CORPORATION, Ina-shi, Nagano (JP)

(72) Inventors: Tadahiko Yoshioka, Ina (JP); Koichi Hirasawa, Ina (JP); Yoshinori Aruga, Ina (JP)

(73) Assignee: KOA CORPORATION, Ina-shi (JP)

( * ) Notice: Subject to any disclaimer, the term of this patent is extended or adjusted under 35 U.S.C. 154(b) by 128 days.

This patent is subject to a terminal disclaimer.

(21) Appl. No.: 14/102,762

(22) Filed: Dec. 11, 2013

(65) Prior Publication Data

US 2014/0097933 A1 Apr. 10, 2014

Related U.S. Application Data

(63) Continuation of application No. PCT/JP2012/067283, filed on Jul. 6, 2012.

(30) Foreign Application Priority Data

Jul. 7, 2011 (JP) ..... 2011-150691

(51) Int. Cl.

| | |
|---|---|
| ***H01C 1/148*** | (2006.01) |
| ***H01C 1/144*** | (2006.01) |
| ***H01C 13/00*** | (2006.01) |
| ***H01C 17/28*** | (2006.01) |

(52) U.S. Cl.

CPC ..... *H01C 1/148* (2013.01); *H01C 1/144* (2013.01); *H01C 13/00* (2013.01); *H01C 17/28* (2013.01); *H01C 17/281* (2013.01); *Y10T 29/49082* (2015.01)

(58) Field of Classification Search

CPC ..... H01C 1/144; H01C 1/148; H01C 10/00; H01C 1/14; H01C 13/00; H01C 17/28; H01C 17/281

USPC ..... 338/332

See application file for complete search history.

(56) References Cited

U.S. PATENT DOCUMENTS 2,708,701 A * 5/1955 Viola ..... 338/49
4,417,389 A * 11/1983 Lopacki et al. ..... 29/619

(Continued)

FOREIGN PATENT DOCUMENTS

JP 56-93304 A 7/1981
JP 61-120401 A 6/1986

(Continued)

OTHER PUBLICATIONS

International Search Report, dated Oct. 9, 2012, issued in corresponding application No. PCT/JP2012/067283.

(Continued)

*Primary Examiner* — Kyung Lee
(74) *Attorney, Agent, or Firm* — Westerman, Hattori, Daniels & Adrian, LLP

(57) ABSTRACT

Provided is a shunt resistor, which controls an influence of skin effect by high frequency current. The shunt resistor has a rod-shaped resistance body (11), and a pair of main electrode (12), of another material from the resistance body, wherein end faces of the resistance body and the main electrode are bonded. The resistance body (11) has a hole (11*a*) going through in direction where main electrodes are disposed, or a high resistance part (11*b*) going through at its axis portion that is highly resistive than outer part, and low resistance part (11*c*) that is formed in outer of the high resistance part. It is preferable that outer circumference of the resistance body is circle-shaped. Since, current doesn't flow fundamentally in the through hole or the high resistance part, fluctuation band in the current pathway can be reduced. Therefore, change of resistance value by skin effect by high-frequency current can be reduced.

6 Claims, 6 Drawing Sheets

(56) References Cited

U.S. PATENT DOCUMENTS

| | | | | |
|---|---|---|---|---|
| 4,720,697 | A | 1/1988 | Bizzarri | |
| 5,398,549 | A * | 3/1995 | Suzuki | 73/204.26 |
| 2004/0112942 | A1 * | 6/2004 | Durand | 228/115 |
| 2005/0228469 | A1 * | 10/2005 | Zarembo et al. | 607/122 |
| 2009/0195348 | A1 * | 8/2009 | Smith et al. | 338/332 |

FOREIGN PATENT DOCUMENTS

| | | | |
|---|---|---|---|
| JP | 03-78272 | U | 8/1991 |
| JP | 5-82301 | A | 4/1993 |
| JP | 5-79901 | U | 10/1993 |
| JP | 06-224014 | A | 8/1994 |
| JP | 6-224014 | A | 8/1994 |
| JP | 2000-277302 | A | 10/2000 |
| JP | 2008-47571 | A | 2/2008 |
| JP | 2009-216620 | A | 9/2009 |
| JP | 2011-511472 | A | 4/2011 |

OTHER PUBLICATIONS

International Search Report for PCT/JP2010/071694 on mailing date Mar. 1, 2011.

* cited by examiner

SHUNT RESISTOR AND METHOD FOR MANUFACTURING THE SAME

TECHNICAL FIELD

The invention relates to a current detecting resistor, especially relating to a shunt resistor consisting of metal material that uses resistance alloy material as resistance body.

BACKGROUND ART

The shunt resistor is used for observing battery current of electrical charge and discharge so as to prevent the battery trouble beforehand. The shunt resistor is excellent in current detection accuracy, small in current drift, and even if a large current is applied, excessive heat is not generated. The shunt resistor is used in a field where super-low resistance value is required, and for instance, a shunt resistor of plate-shape has been proposed (refer to Japanese laid open patent publication H6-224014).

In case of detecting high frequency current, the plate-shaped resistance body shown in the patent publication, is unsuitable for detecting an accurate current, since skin effect may appear comparatively from early stage of low frequency. That is, as shown in left figure of FIG. 1, high frequency current C flows by skin effect at part in corner of resistance body 11 shown by hatching, and the current becomes difficult to flow at central portion of the resistance body. Accordingly, resistance value rises since effective area of high frequency current flowing decreases. Therefore, accurate detecting current becomes difficult upon the current including high-frequency component.

Even in case of making cross-section of resistance body 11 circle-shaped as shown in right figure of FIG. 1, high frequency current C concentrates at outer part shown by hatching in the figure by skin effect, and resistance value changes. Furthermore, change of resistance value is fewer in case of cross-section of resistance body circle-shaped than that of rectangle-shaped.

SUMMARY OF INVENTION

Technical Problem

The invention has been made basing on above-mentioned circumstances. Therefore object of the invention is to provide a shunt resistor, which controls influence by skin effect by high frequency current.

Solution to Problem

The shunt resistor of the invention has a rod-shaped resistance body, and a pair of main electrode of another material from the resistance body, wherein end faces of the resistance body and the main electrode are bonded. The resistance body has a hole going through in direction where main electrodes are disposed, or a high resistance part at axis portion that is highly resistive than outer part, and low resistance part that is formed in outer of the high resistance part. It is preferable that outer circumference of the resistance body is circle-shaped.

According to the invention, by installing a through hole or a high resistance part that goes through in direction of its axis inside of rod-shaped resistance body, since current doesn't flow fundamentally in the through hole or the high resistance part, fluctuation band of the current pathway can be reduced.

Therefore, change of resistance value by skin effect by high frequency current can be reduced.

Figure 9:
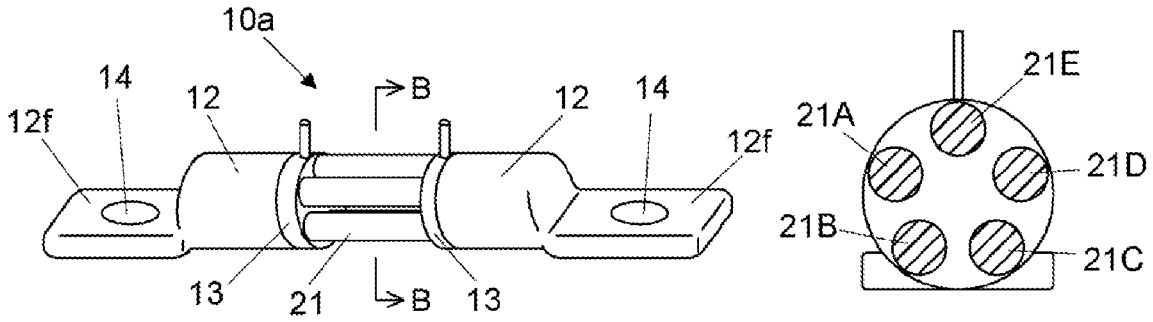

Left view of FIG. 9 is a perspective view according to fourth embodiment of the resistor, and right view of FIG. 9 is an enlarged view looking in direction of arrow at BB cross-section of left view.

Figure 10:
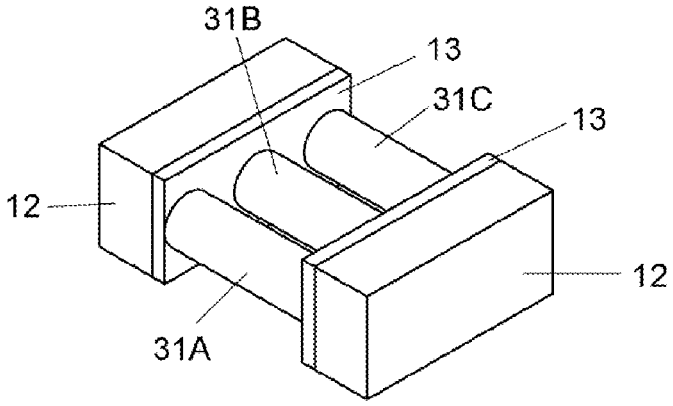

FIG. 10 is a perspective view according to fifth embodiment of the resistor.

DESCRIPTION OF EMBODIMENTS

Embodiments of the invention will be described below with referring to FIG. 2A-FIG. 10. Like or corresponding parts or elements will be denoted and explained by same reference characters throughout views.

FIGS. 2A-2D shows structures of the resistance body of the invention. Resistance body 11 is characterized by pipe-shaped structure having a through hole 11*a* formed in direction where main electrodes (not shown) are disposed at both ends thereof (see FIGS. 2B and 2C), or by resistance body of double-layered structure consisting of high resistance part 11*b* formed in direction of its axis, and low resistance part 11*c* formed in outer of the high resistance part (see FIGS. 2B and 2D). As an example of manufacturing method of the resistance body of the double-layered structure, it is possible to produce the structure by inserting resistance rod 11*b* of high resistivity into pipe-shaped resistance body 11, and integrating them by swaging processing etc.

For instance, resistance alloy material of CuMn-system or CuNi-system of non-magnetism is used for resistance body 11 (11*c*) of low resistance part. These materials have low resistivity and excellent temperature coefficient of resistance. For instance, resistance alloy material of NiCr-system of non-magnetism having higher resistivity than low resistance part is used for resistance rod 11*b*.

Further, skin depth δ where current is distributed by skin effect is expressed by, $$\delta=1/\sqrt{\pi f\mu\sigma} \quad \text{(Equation 1)}$$

provided, f: frequency, μ: permeability of the conductor, σ: conductivity of the conductor. Since magnetism material is a material that passes magnetic flux easily, permeability μ is large, and skin depth δ becomes shallow, then it is preferable to use non-magnetic material with small permeability.

Figure 1:
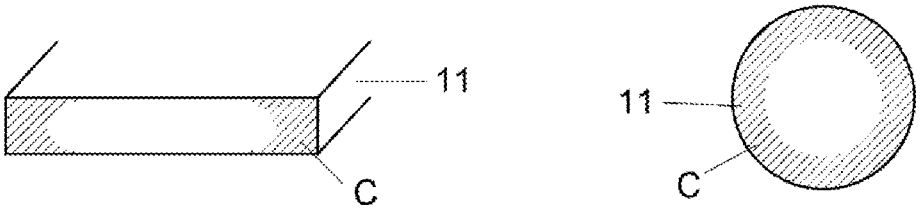
FIG. 1 is views, where left figure shows current distribution in rectangle-shaped cross section of plate-shaped resistance body by skin effect by hatching and right figure shows current distribution in circle-shaped cross section of rod-shaped resistance body by skin effect by hatching.
Figure 2A:
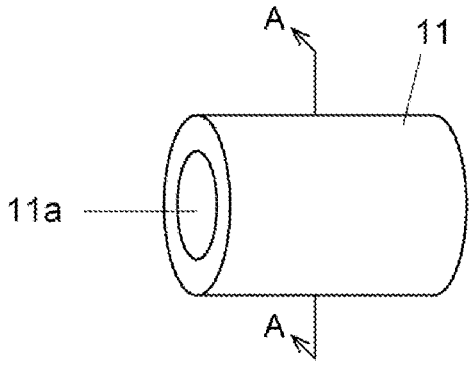
FIG. 2A is a perspective view, which shows rod-shaped resistance body having a through hole or a high resistance part inside thereof.
Figure 2B:
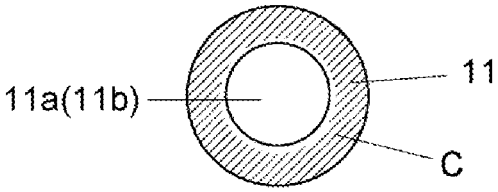
FIG. 2B is a view, which shows current distribution at cross section of FIG. 2A.
Figure 2C:
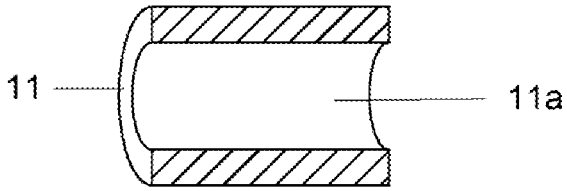
FIG. 2C is a perspective cross-sectional view, which shows a resistance body having a through hole inside thereof along its axis.
Figure 2D:
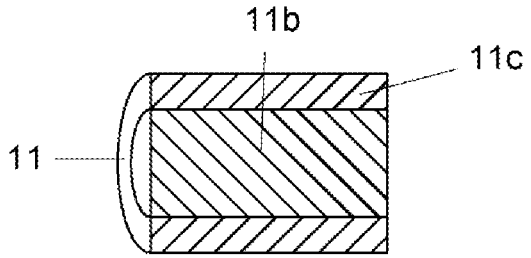
FIG. 2D is a perspective cross-sectional view, which shows a resistance body having a high resistance part inside thereof along its axis.

As a result, as shown in FIG. 2B, current pathway C concentrates at resistance body 11 that is low resistance part, and low frequency current doesn't flow through the hole 11*a* or the high resistance rod 11*b*, then fluctuation band of current pathway C can be reduced. Therefore, change of resistance value by skin effect by high frequency current can be controlled.

Figure 3:
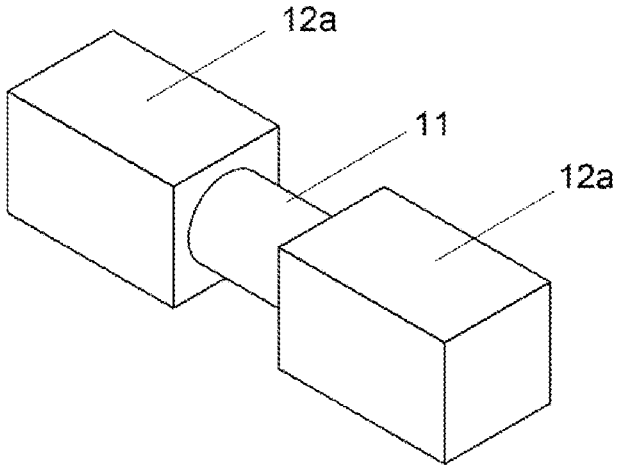
FIG. 3 is a perspective view according to first embodiment of the shunt resistor.
Figure 4A:
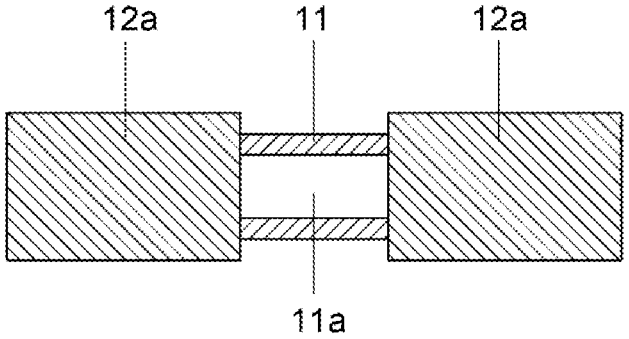
FIG. 4A is a cross-sectional view along its axis of the resistor.
Figure 4B:
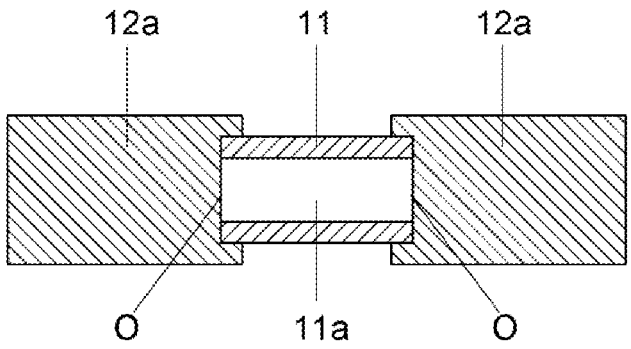
FIG. 4B is a cross-sectional view along its axis of the resistor for showing another structure.
Figure 4C:
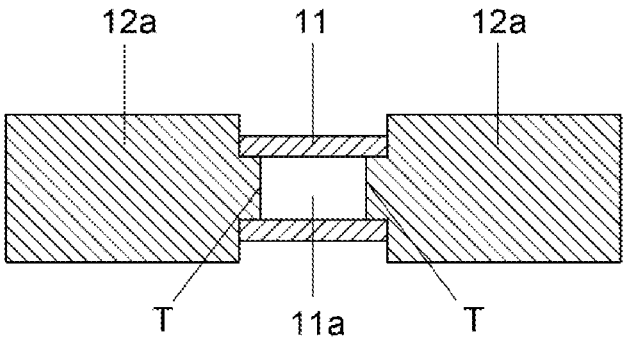
FIG. 4C is a cross-sectional view along its axis of the resistor for showing another structure.

FIG. 3 shows external appearance of the resistor of first embodiment of the invention, and FIGS. 4A-4C respectively shows structural features of resistance body and electrode by section-views along their axis of the resistor. External appearance of the resistor in FIGS. 4A-4C respectively is same with the structure shown in FIG. 3. The resistor is a shunt resistor, which comprises rod-shaped resistance body 11 and square pillar-shaped main electrodes 12*a*, 12*a* of another material from the resistance body connected to both end faces of the resistance body. And, resistance body 11 consists of pipe-shaped structure to have a hole 11*a* that goes through in direction where main electrodes 12*a*, 12*a* are disposed as shown in FIGS. 4A-4C.

Since main electrode 12*a* is square pillar-shaped according to the resistor of the embodiment, the resistor has a feature that it is easy to mount by surface mounting etc. and easy to treat when manufacturing. As to structure 1 of fixing resistance body 11 and main electrode 12*a*, FIG. 4A shows a structure that end faces of pipe-shaped resistance body 11 and square pillar-shaped main electrode 12*a* are abutted and fixed mutually. As structure 2 of fixing resistance body 11 and main electrode 12*a*, FIG. 4B shows the other structure that resistance body 11 is fitted and fixed into concave portion O formed on end face of main electrode 12*a*. As structure 3 of fixing resistance body 11 and main electrode 12*a*, FIG. 4C shows another structure that convex portion T formed on end face of main electrode 12*a* is fitted and fixed into hole 11*a* of resistance body 11.

Pressure bonding, brazing, or welding, etc. is used for fixing main electrode and resistance body. Cold pressure bonding, heat pressure bonding, friction pressure bonding, or ultrasonic pressure bonding etc. can be used for pressure bonding. Laser welding, resistance welding, spot welding, electron beam welding, or arc welding, etc. can be used for welding. (Further, these fixation methods are not limited to embodiment 1, and can be applied to all embodiments 1-5.)

As to fixing structure 2, concave portion O is formed on end face of the main electrode so as to fit to outer circumference of the resistance body for fixing it beforehand. Then end portion of resistance body 11 is fitted into concave portion O and fixed by above-mentioned fixing method.

As to fixing structure 3, convex portion T is formed on end face of the main electrode so as to fit to inner circumference of the resistance body for fixing it beforehand. Then convex portion T is fitted into the hole 11*a* of the resistance body and fixed by above-mentioned fixing method. According to these fixing structures 2, 3, fixing position of resistance body 11 to main electrode 12*a* becomes stable, then, an advantage of easy assembling is caused.

Figure 5:
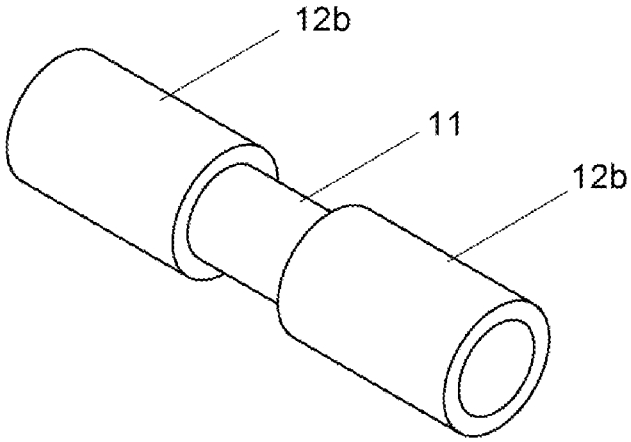
FIG. 5 is a perspective view according to second embodiment of the resistor.
Figure 6:
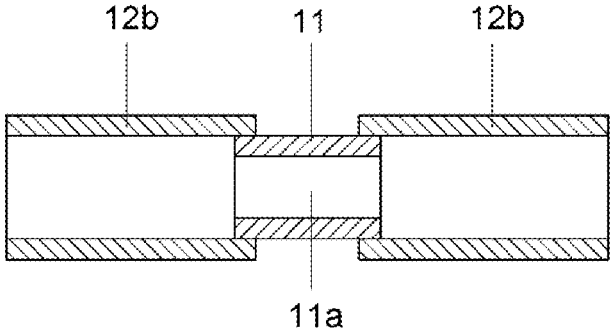
FIG. 6 is a cross-sectional view along its axis of the resistor.

FIG. 5 shows the resistor of second embodiment of the invention, and FIG. 6 shows its cross-section. The resistor is a shunt resistor that cylinder-shaped (pipe-shaped) main electrodes 12*b*,12*b*, which is another material from the resistance body, are fitted and bonded with both end portions of pipe-shaped resistance body 11. And, resistance body 11 consists of pipe-shaped structure that has a hole 11*a* going through in direction where main electrodes 12*b*,12*b* are disposed as shown in FIG. 6.

In this embodiment, pipe-shaped structure of main electrode 12*b* is used as well as resistance body 11. Inside diameter of the hole of main electrode 12*b* is almost same to outside diameter of resistance body 11. End portion of the resistance body fits into the hole of the main electrode, and fixed by above-mentioned fixation method. Moreover, it is acceptable that making inside diameter of the hole of the resistance body almost same to outside diameter of the main electrodes, and main electrodes fit into the hole of the resistance body. Also, it is possible that since main electrode has a hole at both ends, inserting cable into the hole and crushing a portion of the main electrode so as to connect the cable to the main electrode.

In the embodiments, though the resistance body has been explained as cylinder-shaped, the resistance body may be polygonal cylindrical in cross-section such as square-shaped. Moreover, the resistor doesn't have detecting electrodes in this embodiment. In this case, current can be detected at both main electrodes, such as, by welding wires on main electrodes.

Figure 7A:
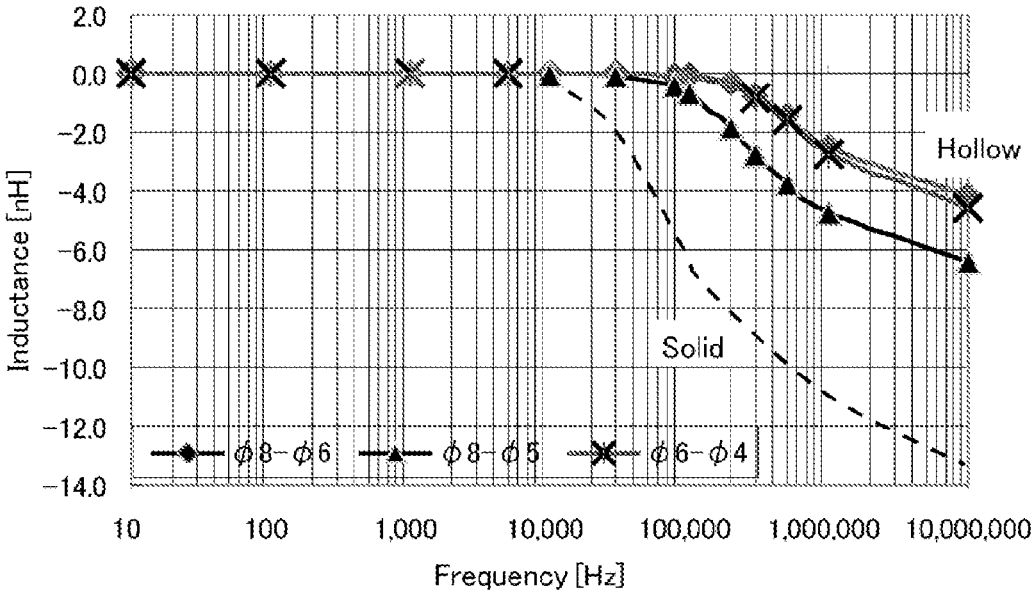
FIG. 7A is a frequency characteristics chart of inductance of the resistor.
Figure 7B:
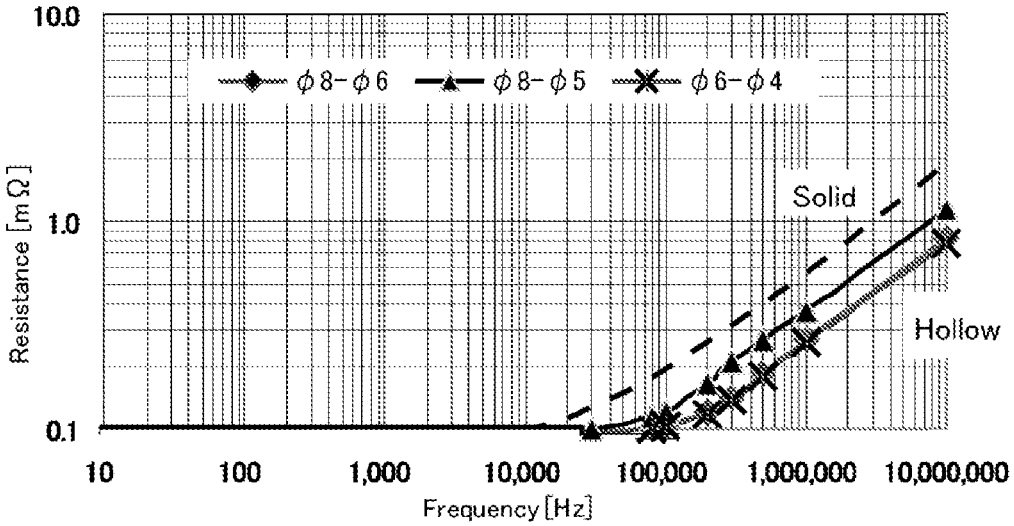
FIG. 7B is a frequency characteristics chart of resistance value of the resistor.

FIGS. 7A and 7B are frequency characteristics charts, where pipe-shaped (hollow) resistance body in these embodiments is compared with no-hole (solid) resistance body as comparative example. FIG. 7A shows change of inductance in cases of changing thickness of pipe-shaped (hollow) resistance body and no-hole (solid) resistance body with changing measurement current frequency. As well, FIG. 7B shows change of resistance in cases of changing thickness of pipe-shaped (hollow) resistance body and no-hole (solid) resistance body with changing measurement current frequency.

In FIGS. 7A and 7B, dashed line shows frequency characteristics of the resistance body of no-hole (solid) as the comparative example, × mark shows pipe-shaped (hollow) resistance body of 6 mm outside diameter and 4 mm inside diameter, Δ mark shows pipe-shaped (hollow) resistance body of 8 mm outside diameter and 5 mm inside diameter, and ◇ mark shows pipe-shaped (hollow) resistance body of 8 mm outside diameter and 6 mm inside diameter. In case of no-hole (solid) resistance body, inductance and resistance increase at frequency of 10 kHz or more, and trouble begins to be caused in use of the shunt resistor.

On the other hand, in case of pipe-shaped (hollow) resistance body, it is understood that increase of inductance and resistance is controlled up to frequency of about 100 kHz. That is, it is understood that by having a through hole in rod-shaped resistance body (by making hollow structure), change of inductance and resistance is improved at higher frequency area, and use of the shunt resistor up to about one digit higher frequency area becomes possible.

In pipe-shaped resistance body, thickness of Δ mark is 1.5 mm and a little thick while × and ◇ marks are 1 mm thickness. From FIGS. 7A and 7B, it is understood that thinner thickness can control rise of inductance and resistance by skin effect up to higher frequency area.

Figure 8:
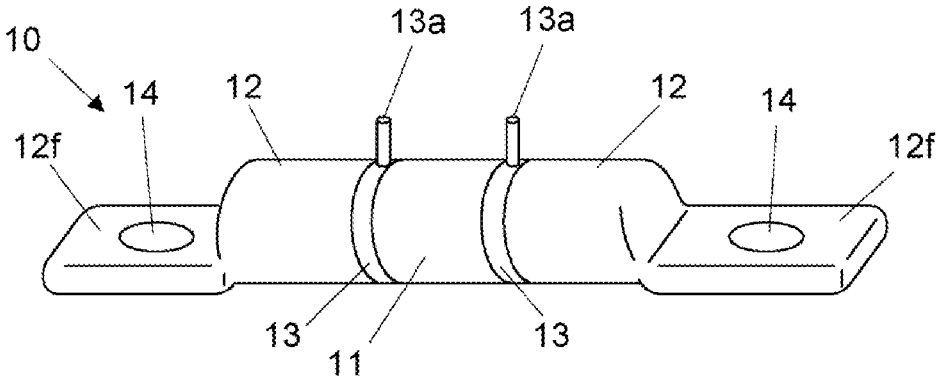
FIG. 8 is a perspective view according to third embodiment of the resistor.

FIG. 8 shows a shunt resistor of third embodiment of the invention. The shunt resistor 10 comprises cylindrical resistance body 11 of resistance alloy material such as Manganin etc, a pair of columnar main electrode 12,12 of high electric conductivity metal material such as copper etc, which is another material from the resistance body, and a pair of plate-shaped voltage detecting electrode 13,13 of high electric conductivity metal material such as copper etc, which is another material from the main electrode. The voltage detecting electrode 13 has detecting terminal 13*a*, which is protruding from the detecting electrode 13, and terminal of voltage detecting circuit is connected to the terminal 13*a* by welding etc.

As shown in FIG. 8, voltage detecting electrode 13 is disposed between resistance body 11 and main electrode 12. And, end face of plate-shaped voltage detecting electrode 13 and end face of columnar main electrode 12 are fixed so as to oppose respectively to both end faces of cylindrical resistance body 11 in length direction. Here, resistance body 11 and voltage detecting electrode 13, and main electrode 12 and voltage detecting electrode 13 are mechanically strongly and electrically stably bonded by above-mentioned fixation method so that each bond-face is abutted. Therefore, at detecting terminal 13*a*, detecting directly the voltage basing on resistance value of resistance body 11 and its temperature coefficient of resistance becomes possible without influence of resistance component of copper material of the main electrode.

According to the shunt resistor 10, since voltage detecting electrode 13 and detecting terminal 13*a* are integral, its assembly process becomes simple. Moreover, difference of fixing position of detecting terminal 13*a* can be controlled, and voltage detection at nearest position to resistance body 11 becomes possible.

Further, since voltage detection electrode 13 becomes a part of the electrode, it never comes off from the bonded portion, it excels in durability, and change of resistance with lapse of time becomes small. And, since there is no lapping portion of electrode and resistance body, it is pillar-shaped as a whole. And since electrode and resistance body are bonded in entire end faces of them, smooth current pathway and heat radiation route are obtained, and bonded strength is also strong.

The shunt resistor 10 has a structure that flatness parts 12*f*, 12*f* are formed at both ends of electrode 12, 12 that is columnar. The flatness part 12*f* has opening 14 therein. And, it forms a structure that bus bar connected with battery etc. can be connected and fixed to flatness part 12*f* by using bolt and nut through opening 14. Opening 14 may be a screw hole, and may fix the bus bar to flatness part 12 by screw stop. Since flatness part 12*f* is formed, it becomes easy to connect and to fix with bus bar or tabular metal terminal fittings.

Next, method for manufacturing the resistor 10 will be described. First, rod-shaped resistance body 11 having a hole therein going through in direction of its axis, or having a high-resistivity portion therein going through in direction of its axis, a pair of main electrode 12,12 of another material from the resistance body, and a pair of voltage detecting electrode 13,13 of another material from the main electrode, are prepared. The resistance body 11 is formed by cutting long rod-shaped material of Manganin etc. into prescribed size, to form a pillar-shaped resistance body 11 having end faces, which are cut faces, at both ends. And, a hole going through in direction of its axis, or a high-resistivity portion going through in direction of its axis, is formed. Main electrode 12 is formed to have end faces, which is cut face, at both ends, by cutting rod-shaped material such as copper into prescribed size similarly. Voltage detecting electrode 13 consisting of plate-shaped part having detecting terminal 13*a* protruding from the electrode, is formed by cutting sheet of copper plate into the shape. Cutting process of copper plate can use press machining, wire-discharge machining, or etching processing etc.

Next, plate-shaped voltage detecting electrode 13 is disposed between resistance body 11 and main electrode 12, and end faces of the electrode 13 are abutted and fixed between end faces of resistance body 11 and main electrode 12, so that these end faces are opposed, by above-mentioned fixation method.

Next, holes are formed at end faces of main electrodes 12,12. Depth of the hole is adjusted in proportion to area of flatness part 12*f* to be formed. Even though the hole may not be formed, however, by forming the hole, it becomes easy to form the flatness part 12*f* with press machining. And, flatness part 12*f* is formed by crushing the part where the hole has been formed. Opening 14 is formed in flatness part 12*f*. By forming flatness part 12*f* at position of lower side of the resistor, bottom face of the resistor becomes almost flat, and it is easy to treat when mounting.

According to above-mentioned process, since electrode and voltage detecting terminal of the resistor can be formed at a time, shunt resistor of high accuracy, of easy handling, and convenient to use can be produced by simple process.

Further, voltage detecting electrode may not be disposed at both end faces of resistance body 11, but end face of main electrode 12, 12 may be abutted and fixed to both end faces of resistance body so as to oppose each other. In this case, it is necessary that voltage detecting wiring be directly fixed to main electrodes.

FIG. 9 shows a shunt resistor of fourth embodiment of the invention. The shunt resistor has a plural of rod-shaped resistance body 21A, 21B, 21C, etc., and a pair of rod-shaped main electrode 12, 12, which is another material from the resistance body, wherein end faces of resistance body 21A, 21B, 21C, etc. and end faces of main electrodes 12,12 are bonded. In the shunt resistor, it is characterized in that a plural of resistance body 21A, 21B, 21C, etc. is disposed in parallel to be bonded and fixed between main electrodes. Further, in FIG. 9, voltage detecting electrode 13 is disposed between main electrode 12 and resistance body 11. However, they may be directly fixed as mentioned above.

The structure is that a plural of resistance body 21A, 21B, 21C, etc, each having circle-shaped cross-section, is disposed on concentric circle in a range. They are disposed to be overcrowded so as not to come in contact mutually. According to equation 1 (see paragraph 0012), it is understood that skin depth is unrelated to diameter of wire. When comparing thick wire with thin wire, since skin depth becomes constant not relating to diameter of wire but relating to frequency, in case of thick wire, big distribution of current becomes formed. On the other hand, in case of thin wire, current flows almost in whole of the section. Accordingly, since in case of thin wire diameter, resistance change by skin effect decreases, then by composing resistance body with a plural of thin diameter wires, influence of skin effect can be decreased even by using resistance body that doesn't have a through hole or a high resistance part in its central portion.

Even if not using thin diameter wire such as skin depth level, by using resistance body of double layer structure that have low resistance part of skin depth level in outer of high resistance part, similar effect can be achieved as mentioned above.

FIG. 10 shows a shunt resistor of fifth embodiment of the invention. The shunt resistor has a plural of rod-shaped resistance body 31A, 31B, 31C, and a pair of rectangular-shaped main electrode 12, 12 of another material from the resistance body, wherein end faces of resistance body 31A, 31B, 31C and main electrodes 12, 12 are bonded. It is characterized in that a plural of resistance body 31A, 31B, 31C is connected and fixed in parallel between the main electrodes 12, 12. Further, in FIG. 10, detecting electrode 13 is disposed between main electrode and resistance body. However, resistance body may be directly fixed to main electrode as mentioned above. Even in the example, by using resistance body of thin diameter wire, the influence of skin effect can be decreased as well as fourth embodiment.

In this embodiment, by using rod-shaped resistance bodies 31A,31B,31C having a through hole therein or two-layer structure where low resistance part is disposed in outer of high resistance part, moreover decrease of change of detected voltage by skin effect can be achieved.

INDUSTRIAL APPLICABILITY

The invention can be suitably used for current detecting resistor consisting of metal material, which uses resistance alloy material as resistance body, especially for the resistor for usage of detecting high frequency current.

The invention claimed is:

1. A shunt resistor comprising:

a rod-shaped resistance body;

a pair of main electrode, which is another material from the resistance body; and a voltage detecting electrode disposed and bonded between the resistance body and the main electrodes, wherein end faces of the resistance body and the main electrodes are bonded; and the resistance body has a hole going through in direction where the main electrodes are disposed, or a high resistance part at its axis portion that is highly resistive than outer part and a low resistance part that is formed in outer of the high resistance part.

2. The shunt resistor according to claim 1, wherein the voltage detecting electrode has a protruding part.

3. The shunt resistor according to claim 1, wherein outer circumference of the resistance body is circle-shaped.

4. The shunt resistor according to claim 1, wherein the main electrodes have a flatness part.

5. The shunt resistor according to claim 1, wherein the end face of the main electrodes has a configuration that can fit in the end face of the resistance body.

6. A method for manufacturing a shunt resistor, comprising:

preparing a rod-shaped resistance body, which has a hole going through in direction of its axis or a high resistance part at its axis portion that is highly resistive than outer part, and a pair of main electrode, which is another material from the resistance body;

abutting the main electrodes to both end portions of the resistance body and fixing them by welding, pressure bonding, or brazing; and disposing and bonding a voltage detecting electrode between the resistance body and the main electrodes.

* * * * *